US010895021B2

(12) United States Patent
Torres Martinez

(10) Patent No.: US 10,895,021 B2
(45) Date of Patent: Jan. 19, 2021

(54) OVEN FOR THE THERMAL TREATMENT OF FILAMENTS

(71) Applicant: Manuel Torres Martinez, Pamplona (ES)

(72) Inventor: Manuel Torres Martinez, Pamplona (ES)

( * ) Notice: Subject to any disclaimer, the term of this patent is extended or adjusted under 35 U.S.C. 154(b) by 328 days.

(21) Appl. No.: 16/084,409

(22) PCT Filed: Jan. 27, 2017

(86) PCT No.: PCT/ES2017/070048
§ 371 (c)(1),
(2) Date: Sep. 12, 2018

(87) PCT Pub. No.: WO2017/158214
PCT Pub. Date: Sep. 21, 2017

(65) Prior Publication Data

US 2019/0078234 A1 Mar. 14, 2019

(30) Foreign Application Priority Data

Mar. 15, 2016 (ES) ..... 201630306

(51) Int. Cl.
*D01D 10/04* (2006.01)
*B65H 57/26* (2006.01)
(Continued)

(52) U.S. Cl.
CPC ..... *D01D 10/04* (2013.01); *B65H 57/26* (2013.01); *D01F 9/32* (2013.01); *F27B 9/28* (2013.01); *F27B 9/30* (2013.01); *F27D 3/12* (2013.01)

(58) Field of Classification Search
CPC ... D01D 10/04; F27B 9/28; F27B 9/30; F27D 3/12
See application file for complete search history.

(56) References Cited

U.S. PATENT DOCUMENTS 4,188,731 A * 2/1980 Rauskolb ..... D21F 5/048 219/216
4,559,010 A * 12/1985 Katsuki ..... D01F 9/225 432/59

(Continued)

FOREIGN PATENT DOCUMENTS

| | | | |
|---|---|---|---|
| EP | 2933032 | A1 | 10/2015 |
| ES | 2528068 | B1 | 2/2015 |
| WO | 2016012641 | A1 | 1/2016 |

OTHER PUBLICATIONS

International Search Report dated Apr. 27, 2017 for PCT/ES2017/070048 and English translation.

*Primary Examiner* — Nathaniel Herzfeld
(74) *Attorney, Agent, or Firm* — Lucas & Mercanti, LLP

(57) ABSTRACT

The invention relates to an oven for the thermal treatment of filaments, which comprises: an oven body (1) having a height greater than its width, with a first end (1.1) and a second end (1.2); conduction means (2) for conducting the filaments, comprising first rotary supports (2.1) and second rotary supports (2.2) between which the filaments are threaded; a platform (3) on which the conduction means (2) for conducting the filaments are arranged and which is pivotably arranged at the first end (1.1) of the oven body (1); and attachment means (4) attaching the platform (3) to the second end (1.2) of the oven body (1), transferring the movements of the second end (1.2) of the oven body (1) to the platform (3), such that it assures that the filaments remain parallel to one another, preventing them from becoming deformed or from coming into contact with one another.

14 Claims, 9 Drawing Sheets

(51) Int. Cl.

| | |
|---|---|
| ***D01F 9/32*** | (2006.01) |
| ***F27B 9/28*** | (2006.01) |
| ***F27B 9/30*** | (2006.01) |
| ***F27D 3/12*** | (2006.01) |

(56) References Cited

U.S. PATENT DOCUMENTS

| | | | | |
|---|---|---|---|---|
| 2015/0329403 | A1* | 11/2015 | Adigrat | C03B 37/0126 65/421 |
| 2016/0376728 | A1* | 12/2016 | Torres Martinez | D01D 7/00 264/206 |
| 2018/0031321 | A1* | 2/2018 | Decker | F27D 7/00 |

* cited by examiner

OVEN FOR THE THERMAL TREATMENT OF FILAMENTS

CROSS REFERENCE TO RELATED APPLICATION

This Application is a 371 of PCT/ES2017/070048 filed on Jan. 27, 2017, which, in turn, claimed the priority of Spanish Patent Application No. P201630306 filed on Mar. 15, 2016, both applications are incorporated herein by reference.

TECHNICAL FIELD

The present invention relates to the processing and treatment of filaments for the manufacture of carbon fiber, proposing an oven with improved structural characteristics that assures that the filaments inside the oven remain parallel during the entire treatment process, preventing them from becoming deformed or from coming into contact with one another. The oven is configured for manufacturing carbon fiber from filaments of a precursor such as polyacrylonitrile (PAN), although the application thereof to this type of polymer is in no way limiting, and the invention may be applied for the manufacture of filaments of other alternative precursors, such as lignin, polyolefins or others having similar characteristics, for example.

STATE OF THE ART

The process of manufacturing carbon fiber from a precursor such as polyacrylonitrile (PAN) essentially comprises a stabilization/oxidation step, a carbonization step, and a surface treatment step. Additionally, when trying to obtain a high-performance fiber, a graphitization step can be added before the surface treatment step, so a graphite fiber is obtained fiber of graphite.

During the stabilization/oxidation step, the PAN precursor undergoes a first transformation to an oxidized state, known as OPAN or oxidized polyacrylonitrile, by means of a double cyclization and dehydrogenation reaction. In addition, a continuous loop structure of hexagonal carbon rings is obtained in the carbonization step from the OPAN. This step is sub-divided into two phases, one at a lower temperature, in which a pyridine structure is formed, and another at a higher temperature, in which the structure collapses into a turbostratic structure.

Both stabilization/oxidation and carbonization are carried out at high temperatures, which are less than 300° C. in the stabilization/oxidation process and which may reach up to 1800° C. or higher in the carbonization process. Said processes are carried out in specific ovens, such as, for example, the oven for manufacturing carbon fiber described in Spanish patent ES 2,528,068 B1 belonging to the same applicant as the present invention.

Said oven comprises therein modules in which the filaments are treated for the transformation thereof into carbon fiber, and conduction means for conducting the filaments formed by an assembly of rotary supports which can be displaced with respect to one another, between which the filaments are passed, which define a height-adjustable storage system for the filaments inside the oven. With this roller configuration, the filaments are vertically arranged inside the modules, remaining parallel to one another as they pass back and forth.

The vertical arrangement allows increasing the filament storage capacity inside the oven, thereby reducing the floor area occupied by same, and therefore reducing the cost of the carbon fiber manufacturing installation. Furthermore, the height-adjustable storage allows regulating the dwell time of the filaments inside the different modules of the oven according to the needs required by the precursor for the manufacture of the carbon fiber.

However, to maximize filament storage capacity and occupy the minimum surface area, ovens of this type have a structure having a height that is much greater than its width, such that the greater the height of the oven, a greater storage capacity is obtained. This structure can present problems relating to stability, since primarily due to adverse weather conditions where the oven is arranged, such as wind, and due to the height and weight of the oven itself, the upper part of the oven may sway back and forth. This swaying causes a lateral displacement of the upper part of the oven that may affect the parallel state of the filaments, such that the filaments may become deformed, or even come into contact with one another.

An alternative oven configuration that allows assuring that the filaments remain parallel to one another throughout the entire treatment process is therefore necessary.

OBJECT OF THE INVENTION

According to the invention, an oven for manufacturing filaments is proposed which is configured for assuring that the filaments remaining parallel to one another as they pass through the inside of the oven when unwanted movements of the upper part of the oven occur, preventing the filaments from becoming deformed or from being able to come into contact with one another.

The oven for manufacturing filaments comprises:

- an oven body having a height that is considerably greater than its width, and having a first end and a second end,
- conduction means for conducting the filaments, comprising first rotary supports and second rotary supports between which the filaments are threaded, where in the usage position for the treatment of the filaments, the first rotary supports are arranged at the first end of the oven body and the second rotary supports are arranged at the second end of the oven body, such that the filaments remain vertically arranged between the first end and the second end of the oven body,
- a platform on which the conduction means for conducting the filaments are arranged, which is pivotably arranged at the first end of the oven body, and
- attachment means attaching the platform to the second end of the oven body, transferring the movements of the second end of the oven body to the platform.

With this oven configuration, it is assured that any movement of the second end of the oven body is transmitted in an identical manner to the platform of the first end of the oven body, such that the vertically arranged filaments are kept tensioned at all times between the first end and the second end of the oven body, the filaments remaining parallel to one another at all times, and preventing them from becoming deformed or from coming into contact with one another.

The attachment means comprise at one of the ends thereof first anchoring points for the fixing thereof to the platform of the first end of the oven body, and at the opposite end they comprise second anchoring points for the fixing thereof to the second end of the oven body.

The anchoring points are distributed in at least two rows parallel to one another, where the anchoring points of each row are aligned with one another, and where the anchoring points of the first row are intercalated with respect to the anchoring points of the second row. This distribution in at least two rows, with the anchoring points of each row intercalated with respect to one another, allows improving the transmission of stresses from the second end of the oven body to the platform, thereby assuring that the platform faithfully reproduces the movements of the second end of the oven body. Therefore, the conduction means carrying the filaments move as a single assembly, preventing deformation of the filaments.

According to a preferred embodiment, each first anchoring point comprises a frustoconical body that is inserted in a reciprocal housing of the platform, whereas each second anchoring point comprises an elastic body which is fixed to the second end of the oven body and which is configured for allowing radial play and pivotal play with respect to the longitudinal axis of the attachment means to which it is attached. Furthermore, the second end of the oven body comprises housings for the passage of the attachment means, where the housings have a diameter that is larger than the diameter of the attachment means passed through the housing. Excess straining in the fixing of the second anchoring points are thereby prevented, which could affect the structural integrity of the attachment means, which could even cause the breaking thereof, since it is precisely this area of the structure of the oven that withstands the highest amount of stresses when a movement of the second end of the oven body occurs.

The platform of the first end of the oven body comprises an arm which is connected to a support base by means of an articulation provided with an axis of rotation. The articulation has a spherical shape that fits in reciprocal gaps of the support base, such that the platform is susceptible to rotating and pivoting with respect to the axis of rotation of the articulation, where any movement originating at the second end of the oven body may be reproduced.

The conduction means for conducting the filaments are arranged inside modules dividing the inside of the oven into different steps of the treatment of the filaments. The modules comprise a structure through which the attachment means pass, where the modules are supported on the platform of the first end of the oven body and are attached to the second end of the oven body through the attachment means. In this way, the attachment means also transmit the movements of the second end of the oven body to the modules incorporating the conduction means for conducting the filaments, likewise assuring that the modules remain vertically arrange at all times between the first end and the second end of the oven body.

The modules are arranged on the platform in columns of modules, each of said columns of modules comprising a front access door that can be driven by driving means, which consist of cylinders which are connected at the free end thereof to the front access door and fixed at the other end thereof to the cross beam. These doors are provided to make access to the inside of the modules easier and to allow carrying out cleaning or maintenance tasks.

The oven additionally comprises sensor means which are configured for measuring the movements of the second end of the oven body and displacement means which are configured for moving the platform depending on the movements measured by the sensor means. With this solution, the attachment means are partially released in the transmission of the movement to the platform, so the service life thereof is increased and the response rate of the entire assembly is improved.

An oven for manufacturing carbon fiber filaments is thereby obtained, which oven, due to its constructive and functional characteristics, allows assuring a suitable passage of the filaments through the inside of the oven regardless of the movements that may originate in the structure of the oven, the filaments remaining parallel to one another at all times, preventing them from becoming deformed or from coming into contact with one another.

DETAILED DESCRIPTION OF THE INVENTION

The invention relates to an oven for manufacturing filaments, which is particularly configured for the application thereof in the manufacture of carbon fiber filaments from the treatment of polyacrylonitrile (PAN) filaments, without this application being limiting.

Figure 1:
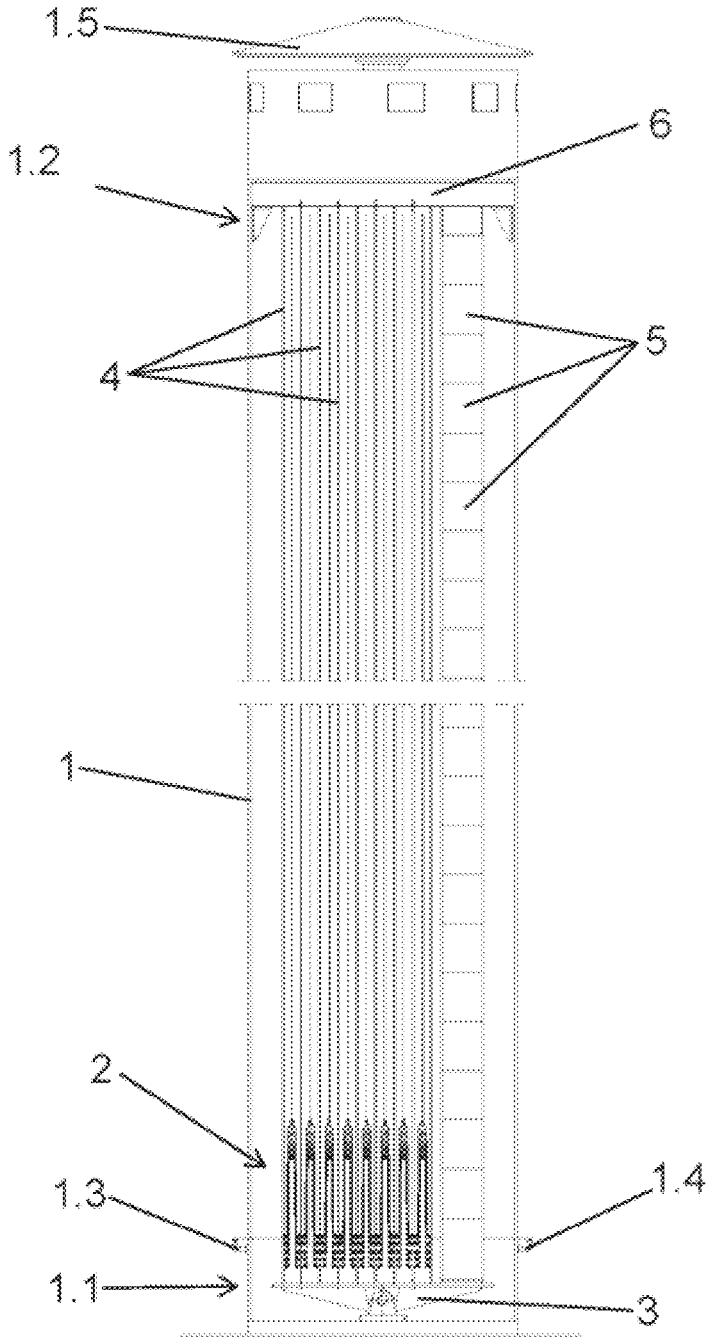
FIG. 1 is a front view that partially shows the inside of the oven of the invention.

The oven comprises an oven body (1) of a rectangular longitudinal section having a height that is considerably greater than its width, similar to a wind-driven power generator tower, as shown in the partial section view of FIG. 1. The cross section of the oven body (1) is likewise provided as being circular in shape, although this configuration is not limiting, where the cross section may be oval or polygonal in shape.

The oven body (1) has an elongated shape with a first end (1.1) and a second end (1.2) opposite the first end (1.1). As shown in the drawings, the first end (1.1) corresponds with the lower part of the oven, and the second end (1.2) corresponds with the upper part of the oven, although the second end (1.2) of the oven body (1) could be any intermediate point located between the lower part and the upper part of the oven body (1).

At the first end (1.1) of the oven body (1), there is arranged an inlet (1.3) for the untreated filaments, and on the opposite side of the first end (1.1) there is arranged an outlet (1.4) for the treated filaments after they have circulated inside the oven after having successively passed back and forth therein, and after having been subjected to stabilization, oxidation, and carbonization steps for the transformation thereof into carbon fiber. At the second end (1.2) of the upper part of the oven body (1) there is arranged an outlet for the circulated gases (1.5) used in the filament treatment steps.

Inside the oven body (1) there is arranged a storage system for storing the filaments comprising conduction means (2) through which the filaments are passed for conducting them through the inside of the oven in the successive back and forth passages between the inlet (1.3) and the outlet (1.4) of the oven body (1).

The conduction means (2) comprise first rotary supports (2.1) formed by vertically arranged rollers and second rotary supports (2.2) likewise formed by other vertically arranged rollers. The first rotary supports (2.1) are connected to the first end (1.1) of the oven body (1), whereas the second rotary supports (2.2) are connected to the second end (1.2) of the oven body (1).

Figure 2A:
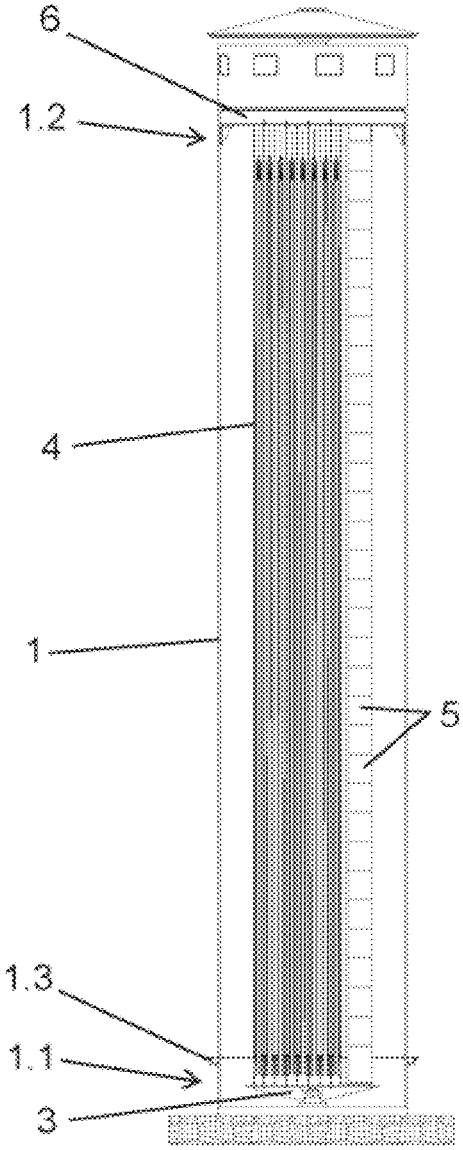
FIG. 2A is a front view of the oven in the usage position, with the vertically arranged filaments being tensioned between the first end and the second end of the oven body.
Figure 4:
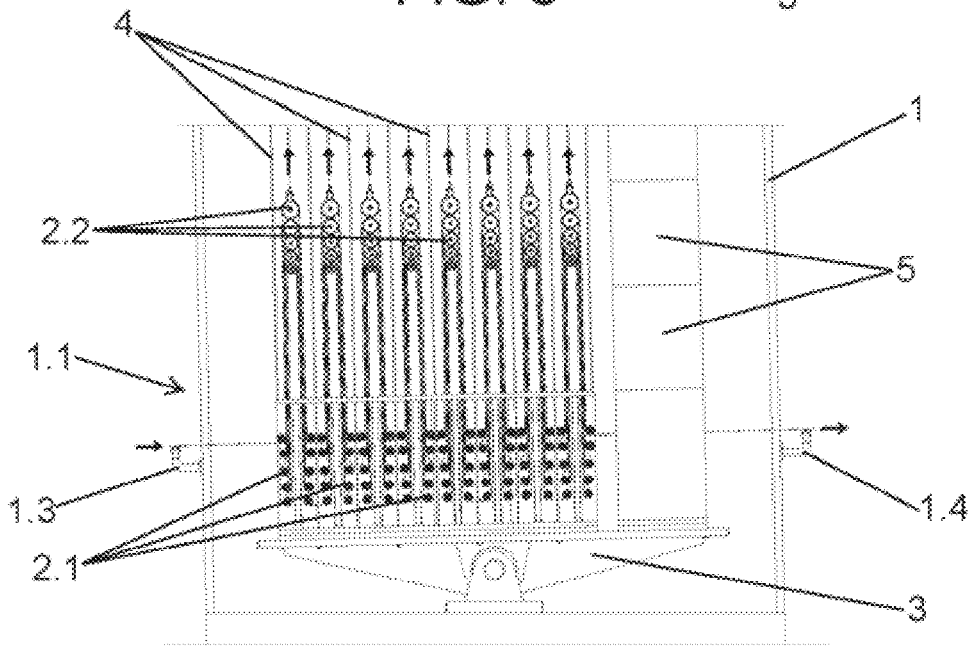
FIG. 4 shows a detail of the first end of the oven body when the second end of the body of the oven is laterally displaced

The rotary supports (2.1, 2.2) can be displaced with respect to one another in the vertical direction, such that at least one of the rotary supports (2.1, 2.2) can be displaced vertically with respect to the other rotary support (2.1, 2.2). As can be seen in the examples of FIGS. 2A, 2B, and 4, the second rotary supports (2.2) can be vertically displaced, with respect to the first rotary supports (2.1), between the first end (1.1) and the second end (1.2) of the oven body (1), whereas the first rotary supports (2.1) are arranged in a fixed manner at the first end (1.1) of the oven body (1).

The second rotary supports (2.2) may be adjusted in height with respect to one another, such that the variable displacement in the vertical direction of the rotary supports (2.2) allows the treatment time in each of the steps inside the oven to remain constant for any rate of supply of the filaments, which is a feature that is beneficial to the startup and shutdown processes, preventing the loss of large amounts of material due to an incomplete filament treatment.

Figure 3:
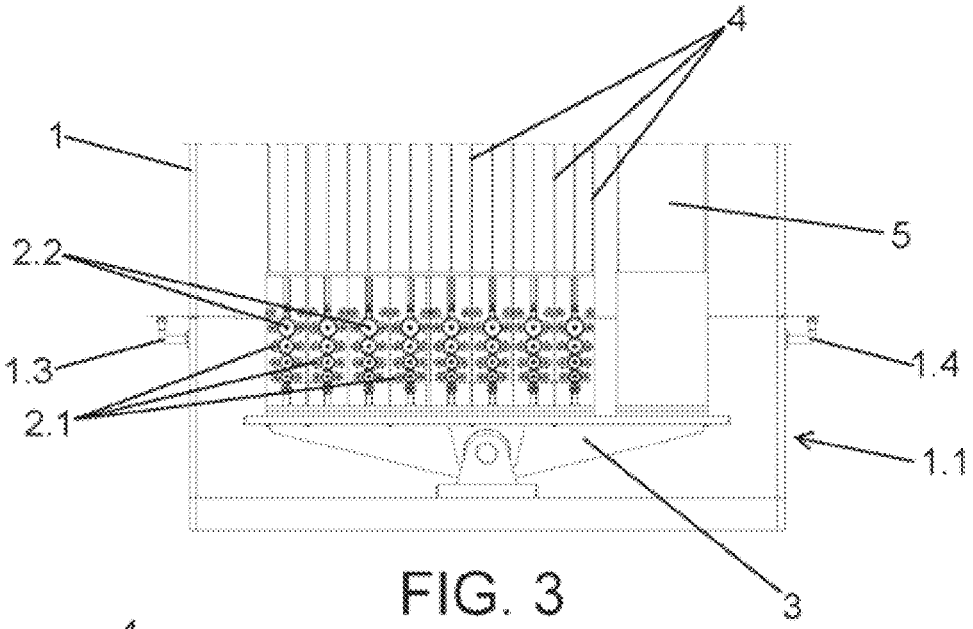
FIG. 3 shows a detail of the first end of the oven body during the threading of the filaments between the rotary supports.

With this arrangement, in order to thread the filaments between the conduction means (2), firstly the second rotary supports (2.2) are displaced to the first end (1.1) of the oven body (1) in order to be intercalated between the first rotary supports (2.1), then the filaments are introduced through the inlet (1.3), passing them between the rotary supports (2.1, 2.2) and taking them out through the outlet (1.4), as shown in FIG. 3. Once the filaments are threaded between the rotary supports (2.1, 2.2), the second rotary supports (2.2) are displaced to the second end (1.2) of the oven body (1), such that the filaments are tensioned between the rotary supports (2.1, 2.2) vertically arranged between the first end (1.1) and the second end (1.2) of the oven body (1), as can be seen in FIG. 2A, the filaments remaining parallel to one another as they successively pass back and forth inside the oven.

Figure 2B:
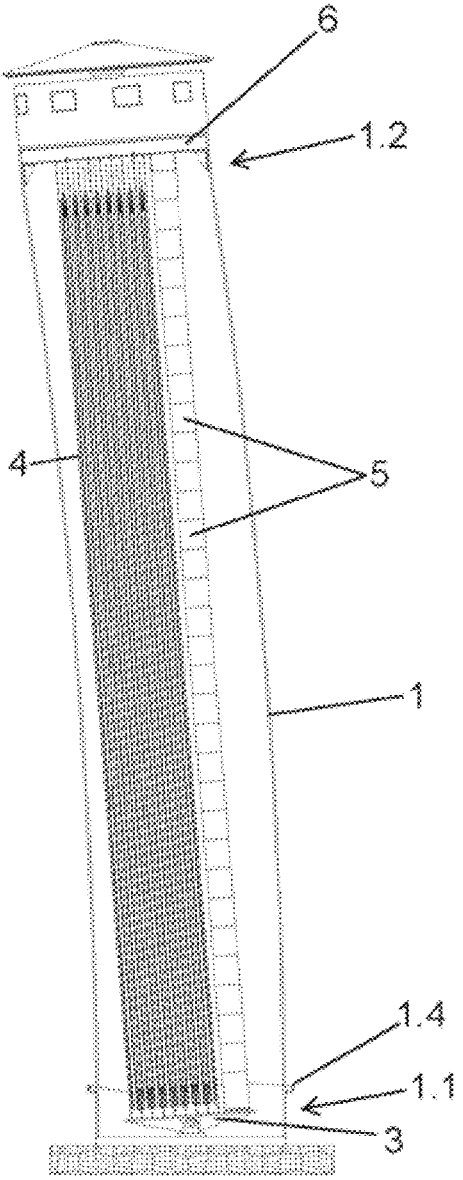
FIG. 2B shows the second end of the body of the oven that has been laterally displaced, but with the vertically arranged filaments likewise being tensioned between the first end and the second end of the oven body.

As depicted in FIG. 2B, the oven body (1) may sway, primarily due to the action of the force of the wind to which the oven may be subjected at the site where it is installed, this swaying worsening due to the weight of the oven body (1) and due to its elongated shape with a height that is considerably greater than its width. Therefore, the second end (1.2) of the oven body (1) can be laterally displaced in any direction, which has a negative effect on the vertical arrangement of the filaments which are arranged between the rotary supports (2.1, 2.2) of the conduction means (2), which may become deformed or come into in contact with one another, depending on the degree of swaying of the oven body (1).

To assure that the filaments remain vertically arranged between the first end (1.1) and the second end (1.2) of the oven body (1) and are suitably parallel to one another, the oven of the invention additionally comprises a platform (3) and attachment means (4). The platform (3) is pivotably arranged at the first end (1.1) of the oven body (1), and the conduction means (2) for conducting the filaments are arranged thereon, whereas the attachment means (4) attach the platform (3) to the second end (1.2) of oven body (1), transferring the movements of the second end (1.2) of oven body (1) to the platform (3).

The swaying of the second end (1.2) of the oven body (1) is thereby transmitted to the platform (3) supporting the conduction means (2) for conducting the filaments through the attachment means (4), thereby assuring at all times that the filaments remain vertically arranged between the first end (1.1) and the second end (1.2) of the oven body (1), being suitably parallel to one another, preventing them from becoming deformed or from coming into contact with one another, as can be seen in FIG. 2B, i.e., while the filaments pass back and forth they remain at all times perpendicular to the horizontal planes defined by the first end (1.1) and the second end (1.2) of the oven body (1).

It has been provided that the attachment means (4) are mechanical cables, which are not entirely rigid but rather a certain degree of flexibility to enable absorbing the tensile stresses to which the oven body (1) is subjected during swaying, such as, for example, cables with interlocking steel tow ropes.

Figure 5:
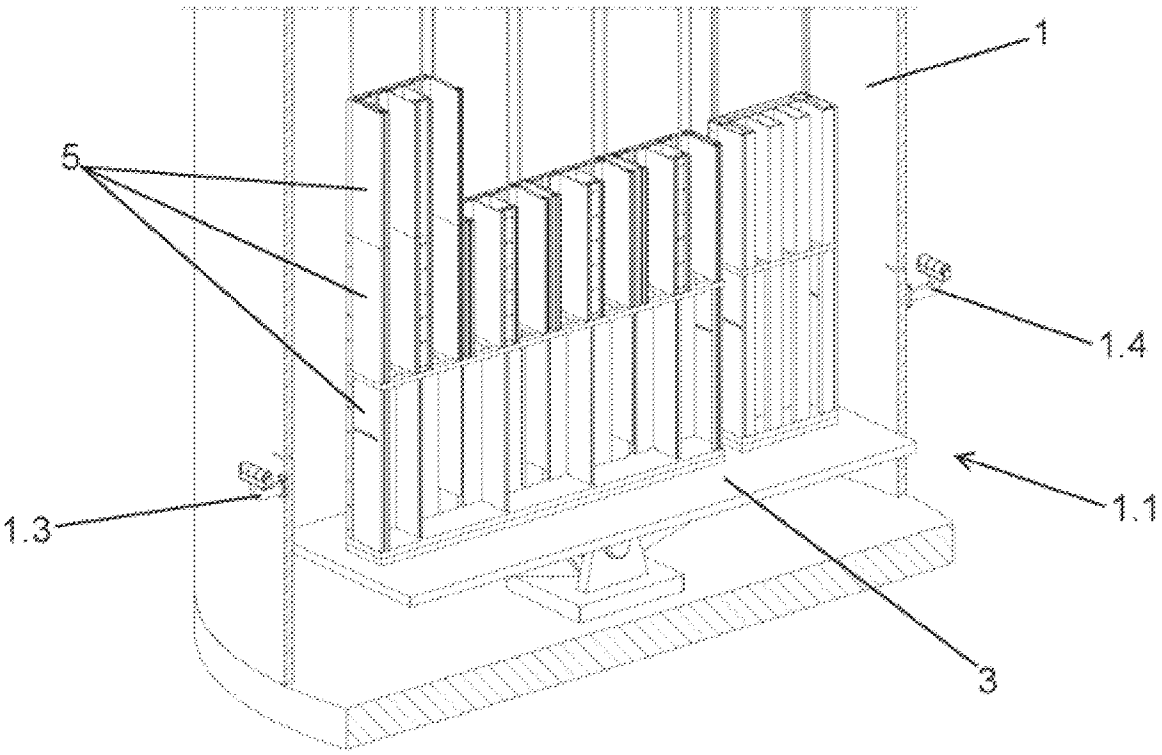
FIG. 5 shows a perspective view of the first end of the oven body in which the modules for the treatment of the filaments can partially be seen.

The oven body (1) comprises therein modules (5) in which the stabilization, oxidation, and carbonization steps are carried out for treating the filaments and transforming them into carbon fiber. The modules (5) comprise therein the conduction means (2) for conducting the filaments and have hot gas inlets (not depicted in the drawings) for creating the conditions necessary for treating the filaments in each step. FIG. 5 shows a perspective view of the inside of the oven, in which for the sake of clarity the modules (5) are only partially depicted and without the conduction means (2). As can be seen in said FIG. 5, there is arranged on the left side of the platform a first assembly of modules (5) in which the filament stabilization and oxidation steps are carried out, and there is arranged on the right side of the platform a second assembly of modules (5), independent of the first assembly, in which the filament carbonization step is carried out.

The modules (5) comprise a structure incorporating refractory material to reduce energy losses due to heat leaking out between the modules (5) and the outside, and between the modules (5) themselves. The structure of the modules is used for passing the attachment means (4) through same, such that the stresses of the second end (1.2) of the oven body (1) are transmitted to the modules (5) through the attachment means (4).

The modules (5) comprising the conduction means (2) are arranged between the first end (1.1) and the second end (1.2) of the oven body (1). The modules (5) are supported on the platform (3) of the first end (1.1) of the oven body (1), whereas in relation to the second end (1.2) of the oven body (1), the attachment of the modules (5) to the second end of the oven body (1) is performed by attachment means (4), as can be seen in detail in FIGS. 11 and 12. The modules (5), the conduction means (2), and the filaments thereby form an assembly that is arranged on the pivoting platform (3) and attached to the second end (1.2) of the oven body (1) by the attachment means (4).

It has been provided that the modules (5) through which the attachment means (4) are guided are blocks having small dimensions, preferably less than 1 meter in height. The modules (5) are arranged parallel to one another and stacked one on top of another, favoring their arrangement and alignment for introducing the attachment means (4). Between the blocks forming the modules (5) there is arranged an elastically deformable material which allows offsetting the thermal expansion differences existing between the material with which the attachment means (4) are made and the material forming the modules (5).

The second end (1.2) of the oven body (1) comprises a cross beam (6), preferably an H-cross beam, which is integrally attached by both ends to the oven body (1), such that the stresses to which the oven body (1) is subjected are transmitted directly to the cross beam (6).

The attachment means (4) have at one of the ends thereof first anchoring points (7) for the fixing thereof to the platform (3) of the first end (1.1) of the oven body (1), and at the opposite ends the attachment means (4) have second anchoring points (8) for the fixing thereof to the cross beam (6) of the second end (1.2) of the oven body (1). The anchoring points (7, 8) have a particular distribution that improves the transmission of movements from the cross beam (6) to the platform (3).

Figure 7:
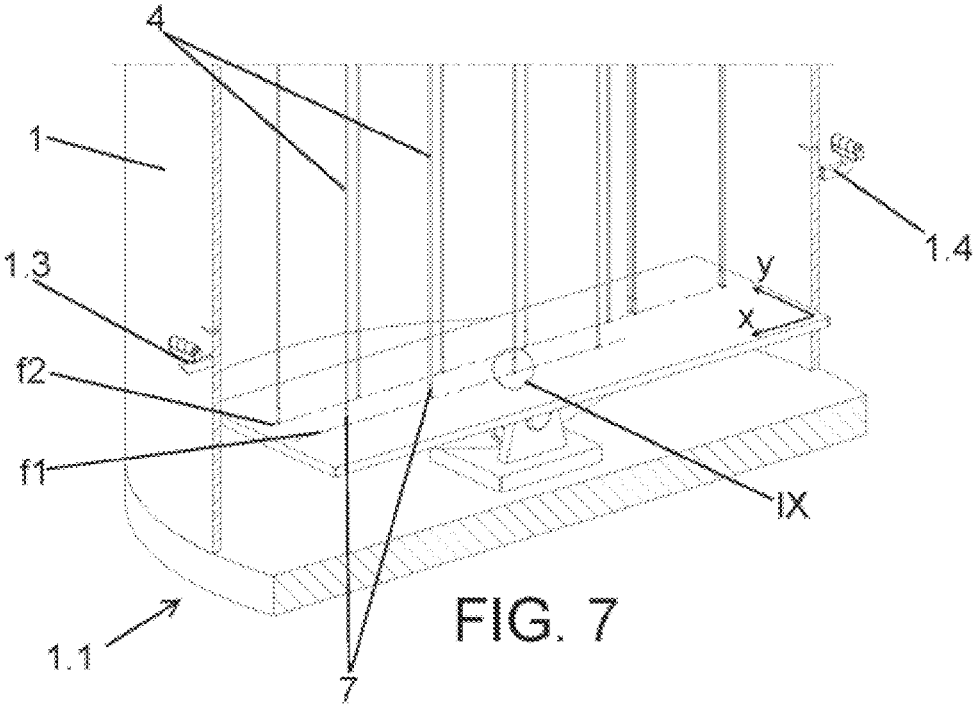
FIG. 7 shows a perspective view of the first end of the oven body in which the first anchoring points fixing the attachment means to the platform can be seen.

As can be seen in detail in FIG. 7, the first anchoring points (7) are distributed in at least two rows (f1, f2) extending in the longitudinal direction (x) of the platform (3), the longitudinal direction (x) being parallel to the larger sides of the platform (3). It has been provided that the anchoring points (7) of each row (f1, f2) are aligned with one another in the longitudinal direction (x), and the two rows (f1, f2) of anchoring points (7) are parallel to one another. This distribution of anchoring points (7) favors the transmission of the stresses to the platform (3), both in the longitudinal direction (x) and in the transverse direction (y), which is parallel to the smaller sides of the platform (3) and perpendicular to the longitudinal direction (x).

This distribution of at least two rows (f1, f2) obviously transmits stresses better than in the case of using a single row of anchoring points aligned in the longitudinal direction (x), where the transmission of movements would only be effective in the longitudinal direction (x), and would not be as effective in the transverse direction (y). Nevertheless, since the cross beam (6) can sway in any direction, the platform (3) must also pivot in any direction to enable reproducing the movements of the cross beam (6); as a result, it has been provided that in addition to the distribution of at least two rows (f1, f2), the first anchoring points (7) have a staggered distribution, in which the anchoring points (7) of the first row (f1) are intercalated with respect to the anchoring points (7) of the second row (f2). This intercalated distribution with respect to the anchoring points (7) of each row (f1, f2) improves the transmission of stresses in all directions, while at the same time minimizing the number of necessary anchoring points.

Figure 6:
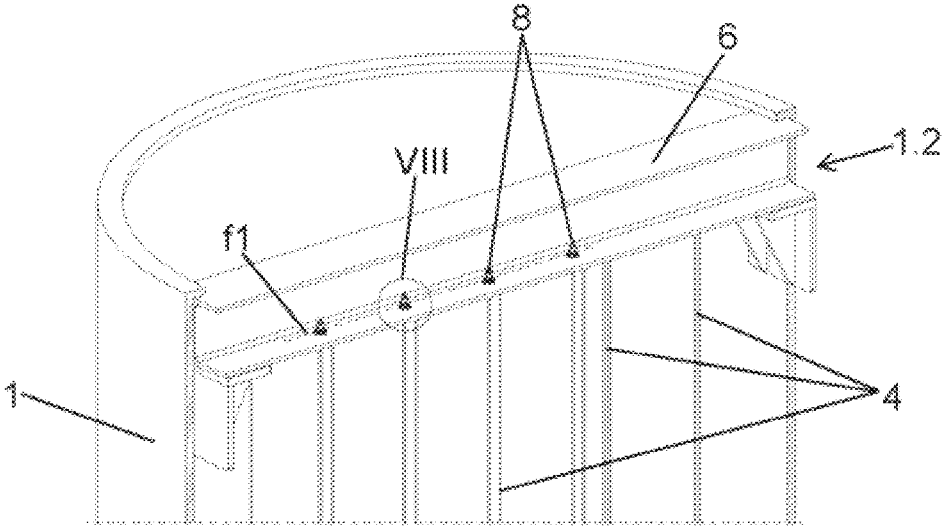
FIG. 6 shows a perspective view of the second end of the oven body in which the second anchoring points fixing the attachment means to the cross beam can be seen.

The distribution of the second anchoring points (8) in the cross beam (6) of the second end (1.2) of the oven body (1) is identical to the distribution of the first anchoring points (7) described above. FIG. 6 only shows the first row (f1) of anchoring points (8), which are arranged in one flange of the cross beam (6), whereas the anchoring points of the second row (f2) are arranged in the other flange of the cross beam (6) which is concealed in FIG. 6.

FIGS. 6 and 7 show that the distribution in at least two rows (f1, f2) is only applied to the first assembly of modules (5) of the stabilization or oxidation step, although it could also be applied on the second assembly of modules (5) of the carbonization step.

Figure 8:
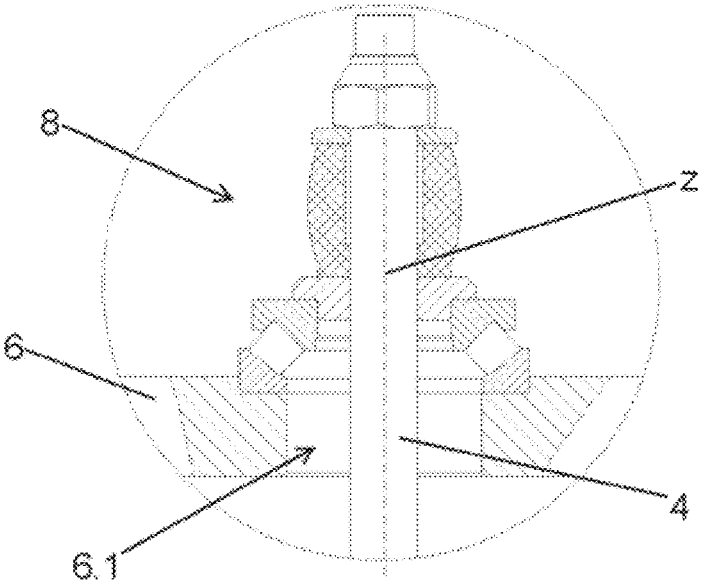
FIG. 8 shows an enlarged longitudinal section view of the detail indicated with reference VIII in FIG. 6.

FIG. 8 shows a longitudinal section view of one of the second anchoring points (8) fixed in the cross beam (6) of the second end (1.2) of the oven body (1). The second anchoring points (8) have a ball joint-like elastic body which allows the attachment means (4) in its area of connection with the second end (1.2) of the oven body (1) to have slight radial play and slight pivoting with respect to the longitudinal axis (z) of the attachment means (4), such that excess straining which could affect the structural integrity of the attachment means (4), and which could even cause the breaking thereof, is prevented.

It can also be observed in FIG. 8 that the cross beam (6) of the second end (1.2) of the oven body (1) has housings (6.1) for the passage of the attachment means (4). The housings (6.1) have a diameter that is larger than the diameter of the attachment means (4) that are passed through it, thereby allowing the attachment means (4) to have slight radial play in the housing (6.1), and excess straining which could affect the structural integrity of the attachment means (4) is likewise prevented.

Figure 9:
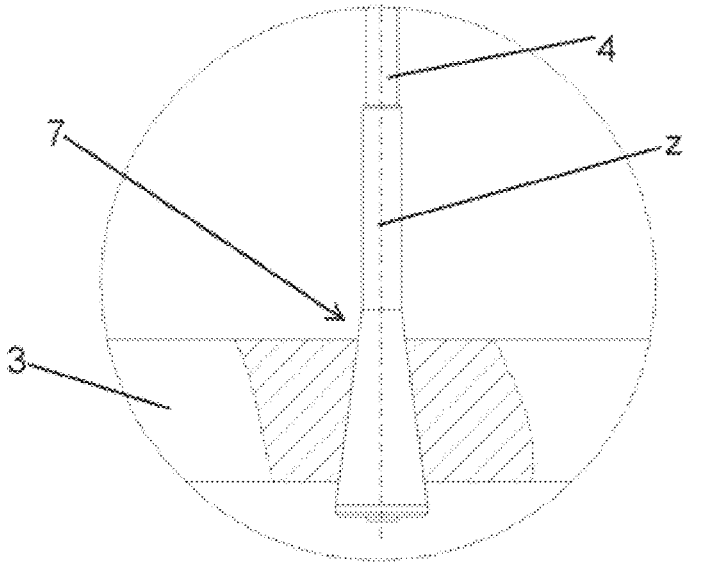
FIG. 9 shows an enlarged longitudinal section view of the detail indicated with reference IX in FIG. 7.

FIG. 9 shows a longitudinal section view of one of the first anchoring points (7) fixed in the platform (3) of the second end (1.2) of the oven body (1). The anchoring point (7) comprises a frustoconical body which is inserted in a reciprocal housing of the platform (3).

With this being the case, for installing the attachment means (4), said means are first introduced through the housings of the platform (3) and then they are introduced into the housings (6.1) of the cross beam (6) of the second end (1.2) of the oven body (1), after which the second anchoring points (8) are tightened for tensioning the attachment means (4), the latter thereby being axially retained by traction between the platform (3) and the second end (1.2) of the oven body (1).

Figure 10B:
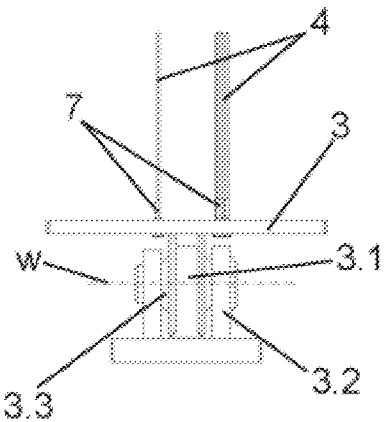
FIG. 10B shows a side view of the platform.
Figure 10A:
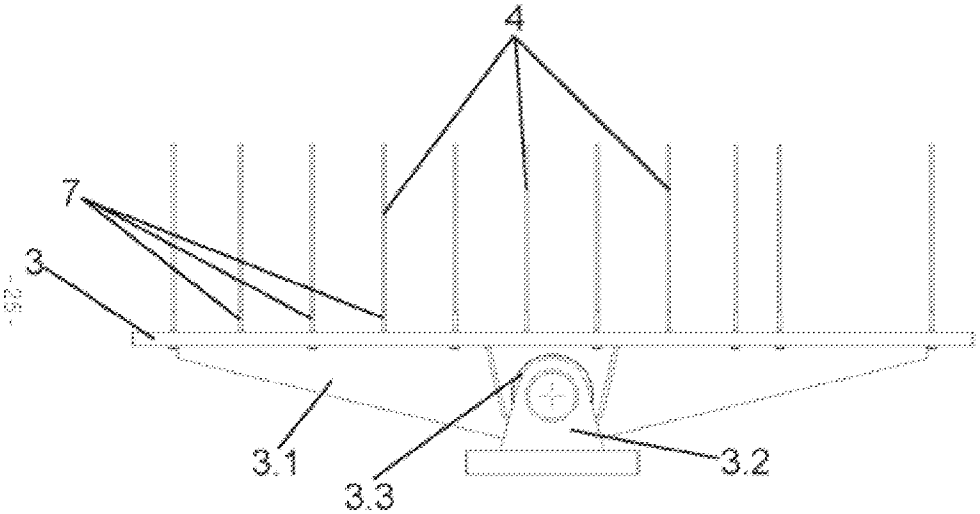
FIG. 10A shows a front view of the platform.

FIGS. 10A and 10B show an embodiment of the platform (3) of the first end (1.1) of the oven body (1) which is supported at a single pivoting point that is centered with respect to the platform (3). In any case, this embodiment is not limiting, as the platform (3) may be supported with other means that allow the pivoting thereof in any direction, such as four pneumatic cylinders arranged at the ends thereof, or another similar arrangement.

The platform (3) comprises a triangular-shaped arm (3.1) which is connected in its lower vertex, by means of an articulation (3.3), to a support base (3.2) provided with two flaps arranged on the floor of the oven. The articulation (3.3) has an axis of rotation (w) which allows the pivoting of the platform (3) with respect to the support base (3.2), and it has a spherical shape that fits in reciprocal gaps of the support base (3.2), such that the articulation (3.3) allows the platform (3) to pivot with respect to the support base (3.3). Specifically, as shown in FIG. 10B, the platform (3) can rotate and pivot with respect to the axis of rotation (w) of the articulation (3.3).

The modules (5) are arranged in columns of modules (5), one module (5) being arranged on top of another, in which each of said columns of modules (5) comprises a front access door (9) that allows accessing the inside of the modules (5) to carryout cleaning or maintenance tasks therein. Each of said doors (9) can opened by driving means (10), which according to the example shown in FIGS. 11 and 12 consist of cylinders which are connected at the free end thereof to the front access door (9) and fixed at the other end thereof to the cross beam (6). Therefore, in order to carry out the opening of a module (5), the cylinder of the driving means (10) is compressed and causes the door of the module (5) that is to be opened to be placed over the door (9) of the module (5) located immediately next to it, as illustrated in FIG. 12. For the sake of clarity, only two of the doors (9) of the modules (5) are shown in FIGS. 11 and 12.

Figure 11:
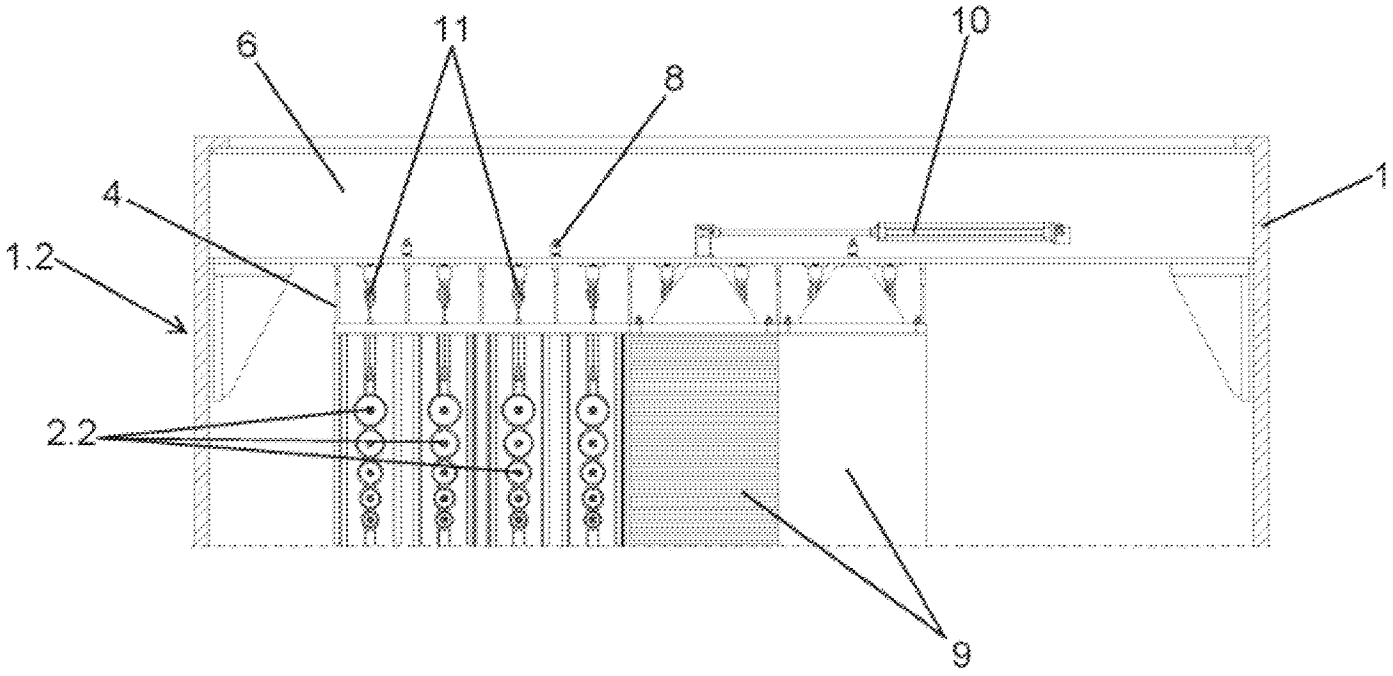
FIGS. 11 and 12 show front views depicting the opening of the doors of the modules.
Figure 12:
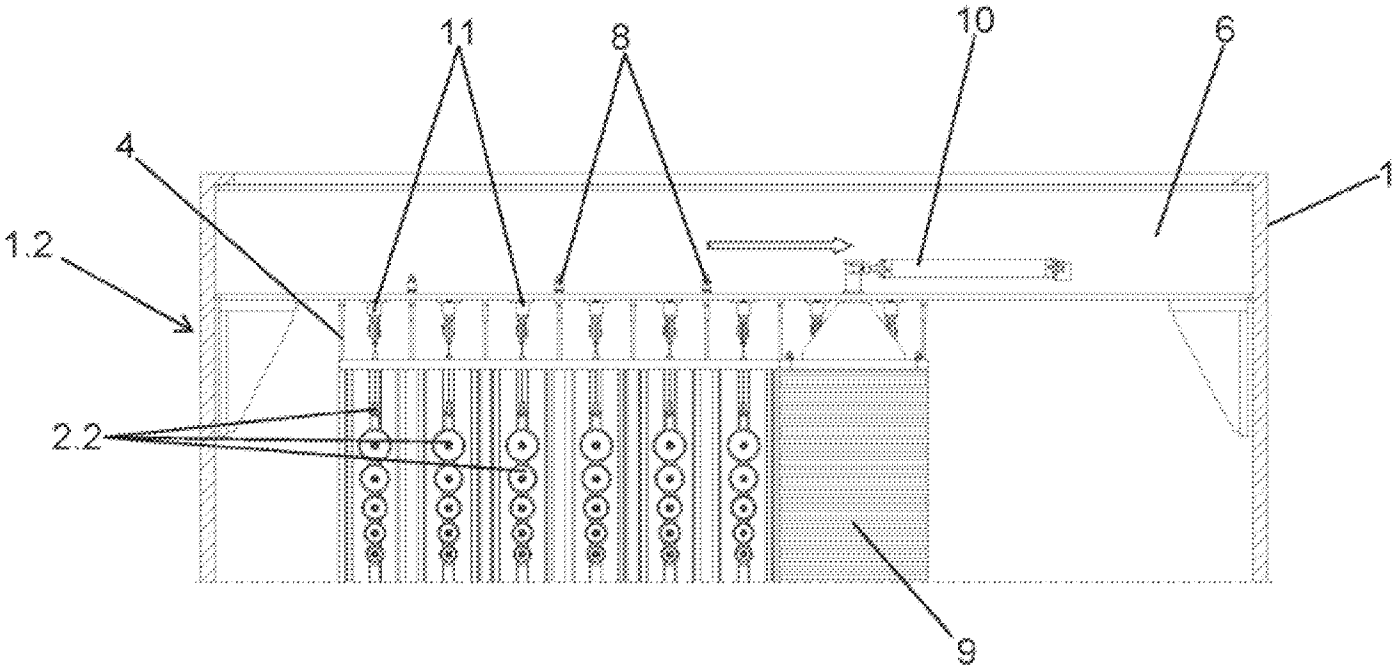

FIGS. 11 and 12 show pulleys (11) which are fixed directly to a flange of the cross beam (6) of the second end (1.2) of the oven body (1). These pulleys (11) are in charge of driving the vertical displacement of the second rotary supports (2.2) for tensioning the filaments which are threaded between the rotary supports (2.1, 2.2). The pulleys (11) are arranged fixed to the cross beam (6) like the attachment means (4), however they do not participate in any case in transmitting movements to the platform (3). The pulleys (11) could be fixed to the upper part of the modules (5), although it has been provided that they are fixed to the cross beam (6) since they are motor-driven pulleys, and the heat of the modules (5) may affect their operation.

Additionally, it has been provided that at the second end (1.2) of the oven body (1) there are arranged sensor means for measuring the movements of the second end (1.2) of the oven body (1), and displacement means moving the platform (3) depending on the movements measured by the sensor means. The sensor means may be any type of means that allow detecting the movements of the second end (1.2) of the oven body (1), such as, for example, accelerometers arranged in the cross beam (6), or elements for measuring the distance between the oven body (1) and the modules (5). The displacement means can be formed by a motor acting directly on the articulation (3.3) of the platform (3). The platform (3) can thereby be acted on immediately once a movement of the second end (1.2) of the oven body (1) is detected, so it is achieved that the attachment means (4), and primarily the second anchoring points (8), withstand fewer stresses when transmitting the movements to the platform (3).

The invention claimed is:

1. An oven for the thermal treatment of filaments, comprising:

an oven body having a height greater than its width and having a first end and a second end, and conduction means for conducting the filaments comprising first rotary supports and second rotary supports between which the filaments are threaded, and where in the usage position the first rotary supports are arranged at the first end of the oven body and the second rotary supports are arranged at the second end of the oven body, such that the filaments remain vertically arranged between the first end and the second end of the oven body, wherein the oven additionally comprises:

a platform on which the conduction means for conducting the filaments are arranged and which is pivotably arranged at the first end of the oven body, and attachment means attaching the platform to the second end of the oven body, transferring the movements of the second end of the oven body to the platform.

2. The oven for the thermal treatment of filaments according to claim 1, wherein the attachment means comprise at an end first anchoring points for the fixing thereof to the platform of the first end of the oven body, and at the opposite end second anchoring points for the fixing thereof to the second end of the oven body.

3. The oven for the thermal treatment of filaments according to claim 2, wherein the anchoring points are distributed in at least two rows parallel to one another, where the anchoring points of each row are aligned with one another, and where the anchoring points of the first row are intercalated with respect to the anchoring points of the second row.

4. The oven for the thermal treatment of filaments according to claim 1, wherein the attachment means consist of mechanical cables that have a certain degree of flexibility.

5. The oven for the thermal treatment of filaments according to claim 2, wherein each first anchoring point comprises a frustoconical body that is inserted in a reciprocal housing of the platform.

6. The oven for the thermal treatment of filaments according to claim 2, wherein each second anchoring point comprises an elastic body which is fixed to the second end of the oven body and which is configured for allowing radial play and pivotal play with respect to the longitudinal axis of the attachment means to which it is attached.

7. The oven for the thermal treatment of filaments according to claim 1, wherein the second end of the oven body comprises housings for the passage of the attachment means, where the housings have a diameter that is larger than the diameter of the attachment means passed through the housing.

8. The oven for the thermal treatment of filaments according to claim 1, wherein the second end of the oven body comprises a cross beam, preferably an H-cross beam, integrally attached by its ends to the oven body, the attachment means being fixed by one of the ends thereof to said cross beam.

9. The oven for the thermal treatment of filaments according to claim 1, wherein the platform comprises an arm which is connected to a support base by means of an articulation provided with an axis of rotation, where the articulation has a spherical shape that fits in reciprocal gaps of the support base, such that the platform rotates and pivots with respect to the axis of rotation of the articulation.

10. The oven for the thermal treatment of filaments according to claim 1, wherein the conduction means for conducting the filaments are arranged inside modules comprising a structure through which the attachment means pass, where the modules are supported on the platform of the first end of the oven body and are attached to the second end of the oven body through the attachment means.

11. The oven for the thermal treatment of filaments according to claim 10, wherein the modules are arranged in columns of modules, each of said columns of modules comprising a front access door which can be driven by driving means.

12. The oven for the thermal treatment of filaments according to claim 11, wherein the driving means consist of cylinders which are connected at the free end thereof to the front access door and fixed at the other end thereof to the cross beam.

13. The oven for the thermal treatment of filaments according to claim 1, wherein the oven additionally comprises sensor means configured for measuring the movements of the second end of the oven body and displacement means configured for moving the platform depending on the movements measured by the sensor means.

14. The oven for the thermal treatment of filaments according to claim 10, wherein the modules are blocks which are arranged parallel to one another and stacked one on top of another, and in that an elastically deformable material is arranged between modules.

* * * * *